US008418410B2

(12) United States Patent
Martin

(10) Patent No.: US 8,418,410 B2
(45) Date of Patent: Apr. 16, 2013

(54) RAIN GUTTER SYSTEM

(76) Inventor: Daniel Robert Martin, Marshville, NC (US)

( * ) Notice: Subject to any disclaimer, the term of this patent is extended or adjusted under 35 U.S.C. 154(b) by 0 days.

(21) Appl. No.: 12/955,974

(22) Filed: Nov. 30, 2010

(65) Prior Publication Data

US 2011/0138697 A1 Jun. 16, 2011

Related U.S. Application Data

(60) Provisional application No. 61/287,058, filed on Dec. 16, 2009.

(51) Int. Cl.
*E04D 13/064* (2006.01)

(52) U.S. Cl.
USPC ..... 52/12; 52/11; 248/48.1

(58) Field of Classification Search ..... 52/11, 12; 248/48.1, 48.2; 210/154, 459, 473
See application file for complete search history.

(56) References Cited

U.S. PATENT DOCUMENTS

| | | | | |
|---|---|---|---|---|
| 2,271,081 | A * | 1/1942 | Layton | 52/12 |
| 3,344,561 | A * | 10/1967 | Anderson | 52/11 |
| 4,713,915 | A * | 12/1987 | Sweers | 52/11 |
| 4,796,390 | A * | 1/1989 | Demartini | 52/12 |
| 5,092,086 | A * | 3/1992 | Rognsvoog, Sr. | 52/12 |
| 5,388,377 | A * | 2/1995 | Faulkner | 52/11 |
| 5,417,015 | A * | 5/1995 | Coyne | 52/11 |
| 5,617,678 | A * | 4/1997 | Morandin et al. | 52/11 |
| 5,619,825 | A * | 4/1997 | Leroney et al. | 52/12 |
| 6,016,631 | A * | 1/2000 | Lowrie, III | 52/12 |
| 6,209,826 | B1 * | 4/2001 | Pratt, Jr. | 248/48.2 |
| 6,543,729 | B1 * | 4/2003 | Ylonen | 248/48.1 |
| 7,117,642 | B2 * | 10/2006 | Brown | 52/11 |
| 7,523,894 | B1 * | 4/2009 | Eddy | 248/48.2 |
| 8,001,729 | B2 * | 8/2011 | Joly et al. | 52/12 |
| 2005/0144851 | A1 * | 7/2005 | Gramling | 52/11 |
| 2005/0204642 | A1 * | 9/2005 | Valentini | 52/12 |
| 2007/0277446 | A1 * | 12/2007 | Dowling et al. | 52/11 |
| 2011/0126477 | A1 * | 6/2011 | Hurn | 52/12 |

FOREIGN PATENT DOCUMENTS

| | | | |
|---|---|---|---|
| DE | 3536266 | A1 * | 4/1986 |
| JP | 06057894 | A * | 3/1994 |

* cited by examiner

*Primary Examiner* — Brian Glessner
*Assistant Examiner* — Brent W Herring
(74) *Attorney, Agent, or Firm* — Oliff & Berridge, PLC

(57) ABSTRACT

A rain gutter system including a gutter and at least one internal hanger, wherein the gutter includes a front wall and a back wall interconnected through a bottom and spaced-apart to cooperatively define a water-collecting channel therebetween, the front wall including a lip extending in the direction toward the back wall and a drip edge extending in a direction away from the back wall, the back wall extending upward vertically beyond the height of the front wall, and wherein the at least one hanger is positioned in the channel spaced-apart from the bottom and includes a forward flange extending upwardly from a base for being captured beneath the lip and a rear flange extending upwardly from the base and defining a support surface sloped in a direction toward the drip edge.

18 Claims, 5 Drawing Sheets

RAIN GUTTER SYSTEM

CROSS-REFERENCE TO RELATED APPLICATION

This non-provisional utility patent application claims priority to U.S. Provisional Application No. 61/287,058 filed Dec. 16, 2009 and entitled "GUTTER SYSTEM", the contents of which are incorporated by reference herein.

TECHNICAL FIELD AND BACKGROUND OF THE INVENTION

1. Field of the Invention

The present invention relates generally to the field of rain gutter systems, and more particularly, to a rain gutter system including a gutter having a continuous cross-sectional profile defining an integrated drip edge for directing water away from a front wall of the gutter and a high-back for protecting the underlying fascia against backflow, the system further including at least one internal hanger for securing the gutter to underlying fascia/rafter tails and supporting an overlying debris cover at a predetermined slope in the direction toward the drip edge.

2. Background of the Invention

Various prior art gutter systems and gutter covers have been developed in an attempt to collect water while preventing debris from collecting within the gutter. Such systems typically require installation methods that disadvantageously damage the sealing integrity of the roof, fail to address "backflow" affecting the underlying fascia and water collection, and include covers oriented at undesirable slopes, causing debris to collect thereon and/or inadequate water collection. Accordingly, the rain gutter system provided herein overcomes the disadvantages of the prior art systems.

BRIEF SUMMARY OF THE INVENTION

In one aspect, a rain gutter system for collecting water run-off from an overlying roof is provided herein.

In another aspect, the rain gutter system is configured for use with a variety of conventional debris covers generally including a channeled member covered with a fine mesh.

In yet another aspect, the gutter includes a continuous cross-sectional profile.

In yet another aspect, the gutter includes an integrated drip edge for directing water away from the front wall of the gutter, and a raised back wall for protecting the underlying fascia against water backflow.

In yet another aspect, the rain gutter system includes at least one internal hanger for securing the gutter to rafter tails underlying the fascia, wherein the at least one hanger is installed using conventional fasteners advanced though the hanger, back wall and fascia into the rafter tails.

In yet another aspect, the back wall extends vertically beyond the height of the front wall and terminates in a fold in the direction of the channel such that a flange of the back wall and a supporting surface of an installed internal hanger define a space therebetween for receiving and maintaining a back edge of an installed debris cover.

In yet another aspect, the internal hangers cooperatively support and determine the slope of the installed debris cover.

In yet another aspect, the internal hangers span and maintain the distance between the front and back walls of the gutter.

In yet another aspect, the internal hangers resist downward rotational forces on the front wall of the gutter.

In yet another aspect, the gutter is formed by bending a single piece of planar material into a predetermined shape having a profile defining a front lip in the direction of the back wall under which a forward edge of the internal hangers is captured, a drip edge extending forward of the front wall in the direction away from the back wall, a high back wall, and a fold at the free end of the back wall in the direction of the channel.

To achieve the foregoing and other aspects and advantages, in one embodiment the present invention provides a rain gutter system including a gutter and at least one hanger, the gutter including a front wall and a back wall interconnected through a bottom and spaced-apart to cooperatively define a water-collecting channel therebetween, the front wall including a lip extending from the front wall in a direction toward the back wall and a drip edge extending beyond the front wall in a direction away from the back wall, the back wall extending upward vertically beyond the height of the front wall and terminating in a fold in a direction toward the bottom, and wherein the at least one hanger secured within the channel between the front wall and the back wall and spaced apart from the bottom, the hanger including a forward flange extending upwardly from a base of the hanger for being captured beneath the lip and a rear flange extending upwardly from the base and defining a support surface sloped in a direction toward the drip edge.

According to another embodiment, the drip edge and the rear flange are coplanar.

According to another embodiment, the rain gutter system includes a debris cover supported on the drip edge and the rear flange and sloped in a direction toward the drip edge.

According to another embodiment, the back wall is linear and perpendicular to the bottom and the front wall is non-linear.

According to another embodiment, the support surface of the rear flange is spaced-apart from a free edge of the fold of the back wall.

According to another embodiment, the rain gutter system includes at least one fastener advanced through the rear flange and the back wall.

According to another embodiment, each of the forward flange and the rear flange are generally L-shaped and face one another.

According to another embodiment, the gutter has a continuous cross-sectional profile.

According to another embodiment, the rain gutter system includes an end cap.

In accordance with another embodiment, the present invention provides a rain gutter system including a gutter having a continuous cross-sectional profile formed to define a front wall and a back wall interconnected through a bottom and spaced-apart to cooperatively define a water-collecting channel therebetween, the front wall including a lip extending from the front wall in a direction toward the back wall and a drip edge extending beyond the front wall in a direction away from the back wall, the back wall extending upward vertically beyond the height of the front wall, and a hanger secured within the channel between the front wall and the back wall and spaced apart from the bottom, the hanger including a forward flange extending upwardly from a base of the hanger for being captured beneath the lip and a rear flange extending upwardly from the base and defining a support surface sloped in a direction toward the drip edge.

Additional features and advantages of the invention will be set forth in the detailed description which follows, and in part will be readily apparent to those skilled in the art from that description or recognized by practicing the invention as described herein.

BRIEF DESCRIPTION OF THE DRAWINGS

These and other features, aspects and advantages of the present invention are better understood when the following detailed description of the invention is read with reference to the accompanying drawings, in which.

DETAILED DESCRIPTION OF THE INVENTION

The present invention will now be described fully hereinafter with reference to the accompanying drawings in which exemplary embodiments of the invention are shown. However, the invention may be embodied in many different forms and should not be construed as limited to the representative embodiments set forth herein. The exemplary embodiments are provided so that this disclosure will be both thorough and complete, and will fully convey the scope of the invention and enable one of ordinary skill in the art to make, use and practice the invention.

It is intended that the gutter system provided herein may be installed as original equipment or as a retrofit application, either as a complete system or utilizing parts of the system disclosed herein. The rain gutter system may additionally be used in conjunction with a rain collection system. In a preferred installation embodiment, conventional fasteners including but not limited to, screws and nails, are advanced through the rear flange of the hangers, the back wall of the gutter and the fascia, and into the underlying rafter tails to support the gutter on a structure. Hangers are preferably installed at spaced-apart intervals along the length of the gutter to adequately support the weight of a loaded gutter. Although any materials may be used in the construction of the system components, preferable materials include those that are lightweight, malleable, corrosion-resistant and paintable, for example aluminum.

The gutter portion of the system is preferably bent/formed from a single planar length of material such that the gutter has a continuous cross-sectional profile, i.e. continuous from the free edge of the lip of the front wall to the free edge of the fold of the back wall. The continuous cross-sectional profile and the addition of an end cap to each end of the length of gutter makes the gutter watertight. The gutter may have any ornamental design, folds and beads. The gutter is preferably bent by machine, such as on-site, to produce the desired profile.

The gutter portion of the system is designed with an overhang or backflow-preventing bend to prevent water from traveling upward or horizontally toward the building. Thus, each component is designed to move water away from or laterally with respect to the building to which the system is attached.

Figure 1:
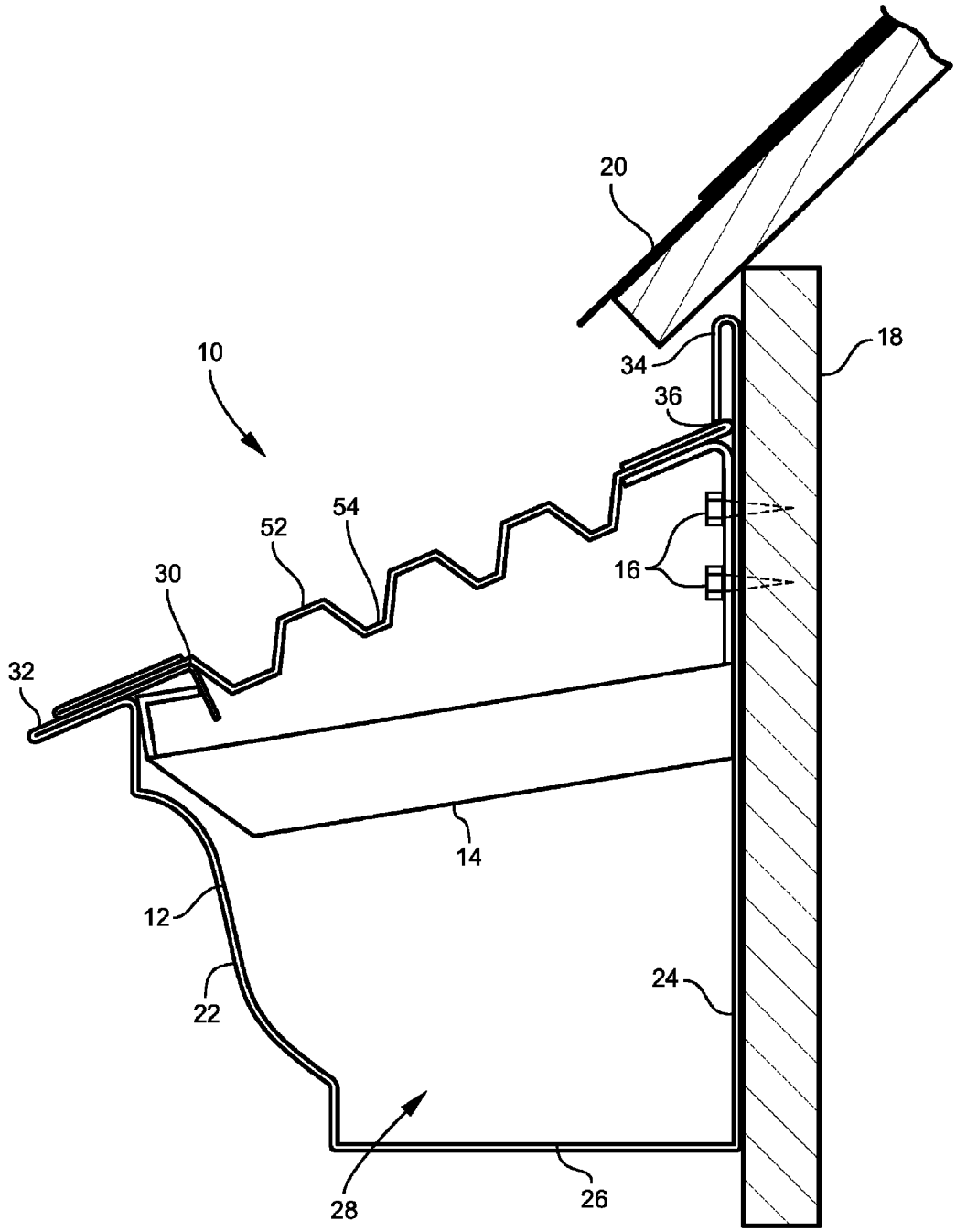
FIG. 1 is a side elevational view of the rain gutter system shown installed and with the end cap removed.

Referring now to the drawings, a rain gutter system according to a preferred embodiment of the present invention is illustrated generally at reference numeral 10. Rain gutter system 10 generally includes a gutter 12 having a cross-sectional profile as best shown in FIG. 1, at least one hanger 14 installed within the gutter 12, and conventional fasteners 16 for securing the gutter to a supporting structure, such as an underlying fascia illustrated at reference numeral 18 in FIG. 1. In a specific embodiment, the gutter 12 is ultimately anchored to underlying rafter tails beneath the fascia 18. As shown, roof 20 overhangs gutter 12 such that water run-off from roof 20 is collected within gutter 12 and does not run down fascia 18. Although not shown, gutter 12 is coupled with at least one downspout for draining water from gutter 12 as known to those skilled in the art. Alternatively, gutter 12 may be coupled to a rain collection system.

Gutter 12 has a continuous cross-sectional profile and includes spaced-apart front wall 22 and back wall 24 interconnected through bottom 26 and cooperatively defining water-collecting channel 28 therebetween. Lip 30 extends from front wall 22 in the direction generally toward back wall 24 and functions to capture a forward flange of the hangers 14 beneath it. Drip edge 32 extends beyond front wall 22 in the direction generally away from back wall 24 such that water running off of drip edge 32 is directed away from the front face of front wall 22, preventing "streaking" or "striping" commonly found in conventional gutter designs. Drip edge 32 preferably has a length corresponding to the length of gutter 12 to provide a continuous drip edge along the entire length of gutter 12. In one example, drip edge 32 extends from about 0.5 to about 1 inch beyond front wall 22. As shown, drip edge 32 and a portion of lip 30 are coplanar, and lip 30 further terminates in a bend downward in the direction toward bottom 26. Thus, lip 30 is non-linear and includes approximately a 90-degree bend for capturing the forward flanges of hangers 14 to resist downward and rotational pulling forces on front wall 22.

Gutter 12 further defines a "high-back" provided by back wall 24 extending upward vertically beyond (i.e. "above") the height of front wall 22. The height of back wall 24 functions to protect underlying fascia 18 from "backflow", i.e. water flowing against the direction of gravity over the top of back wall 24 and to fascia 18. Back wall 24 further terminates in fold 34 in the direction generally toward front wall 22 and bottom 26. Referring specifically to FIG. 1, free edge 36 of fold 34 is spaced apart from the rear flanges of hangers 14 such that the rear edge of a debris cover can be received and maintained in the provided space. The high back wall gutter profile further allows the receipt of hangars 14 sloped in the direction of drip edge 32. As best shown in FIG. 1, back wall 24 is generally linear and perpendicular to bottom 26, and front wall 22 is non-linear and has a decorative profile that may vary.

Referring to FIGS. 1-4, rain gutter system 10 further includes hanger 14, and preferably a plurality of hangers, spaced-apart and secured within gutter 12. Hangers 14 substantially span the distance between front wall 22 and back wall 24 and prevent their movement. Hangers 14 are installed spaced-apart from bottom 26 to avoid obstructing the flow of water longitudinally along channel 28.

Figure 2:
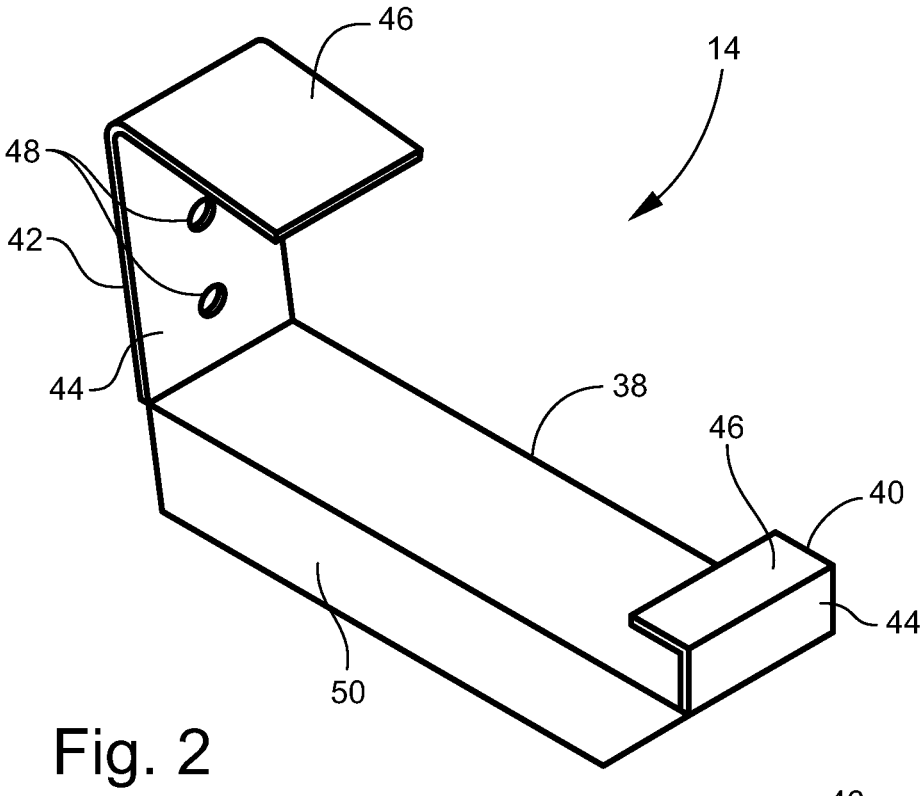
FIG. 2 is a front and left side perspective view of an internal hanger.
Figure 3:
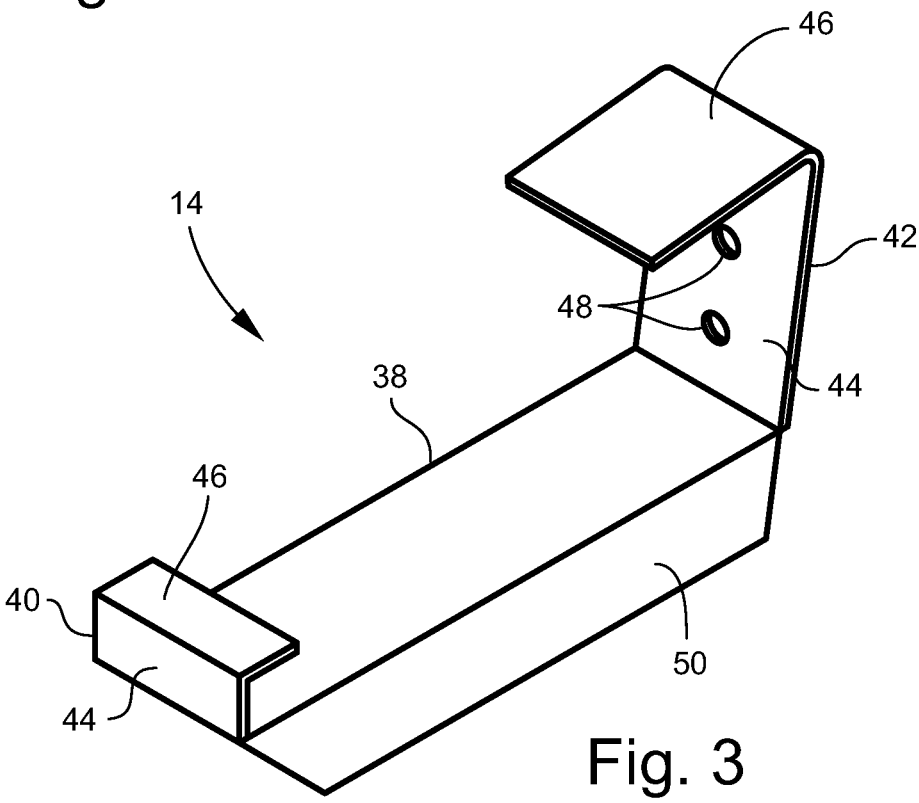
FIG. 3 is a front and right side perspective view if the internal hanger of FIG. 2.

As best shown in FIGS. 2 and 3, hangers 14 are formed from a single piece of material bent to form a complex shape generally including base 38, forward flange 40 and rear flange 42. Forward flange 40 and rear flange 42 are generally L-shaped and include vertical portions 44 extending generally perpendicularly from base 38 and supporting portions 46 oriented substantially perpendicular or at an angle to vertical portions 44 in the direction facing one another. Supporting portion 46, also referred to as "support surface 46", supports an overlying debris cover and is sloped in the direction toward drip edge 32. Rear flange 42 extends vertically beyond forward flange 40 to provide a sloped profile in the direction of forward flange 40. The vertical portions 44 of the rear flanges 42 may define openings 48 therethrough for receiving conventional fasteners 16 for attaching gutter 12 to the structure. Base 38 includes downward flanges 50 to provide rigidity to hangers 14, thus resisting twisting and bending forces.

Figure 4:
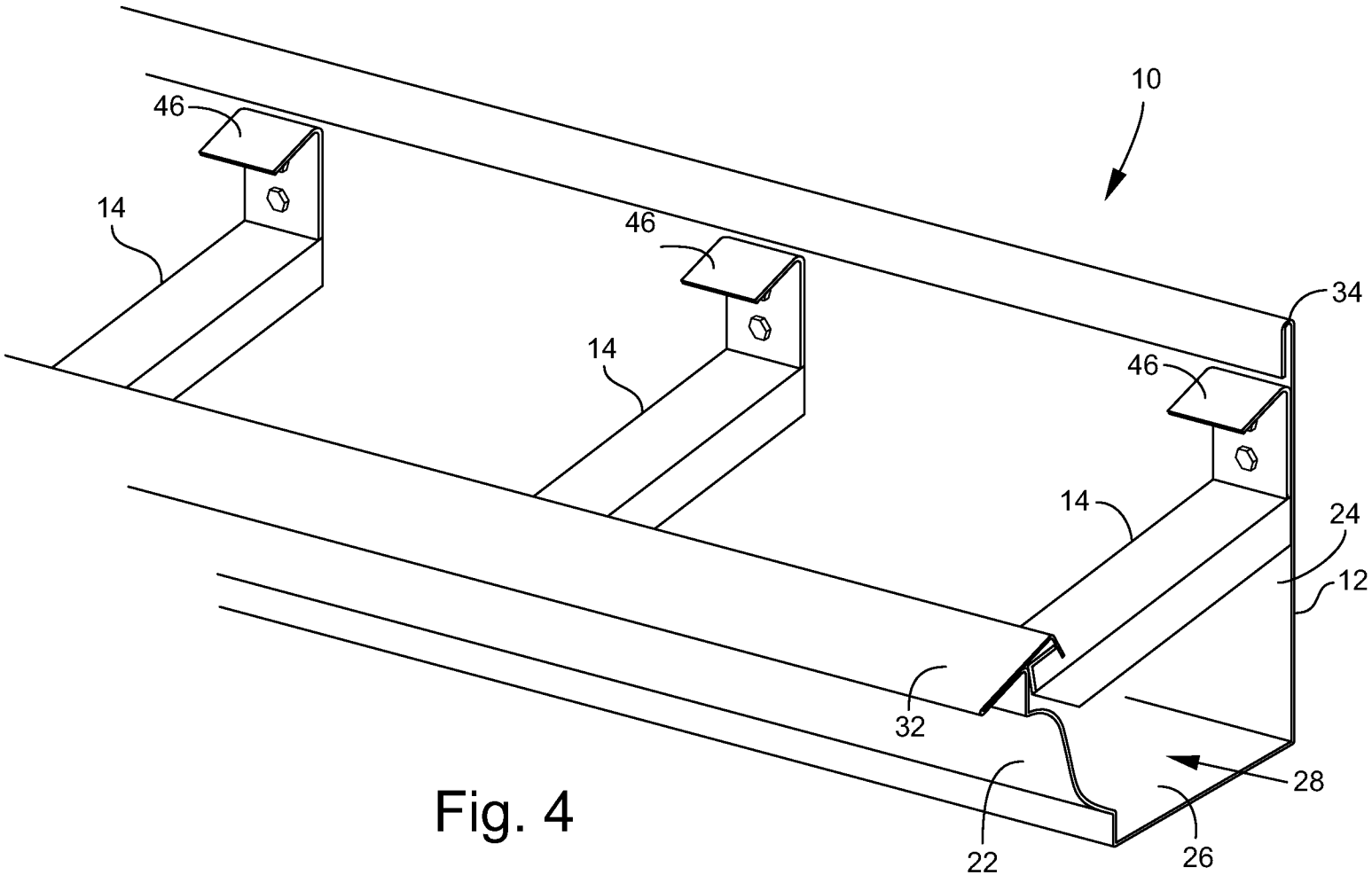
FIG. 4 is a front and right side perspective view of the rain gutter system shown with the gutter cover and end cap removed.
Figure 5:
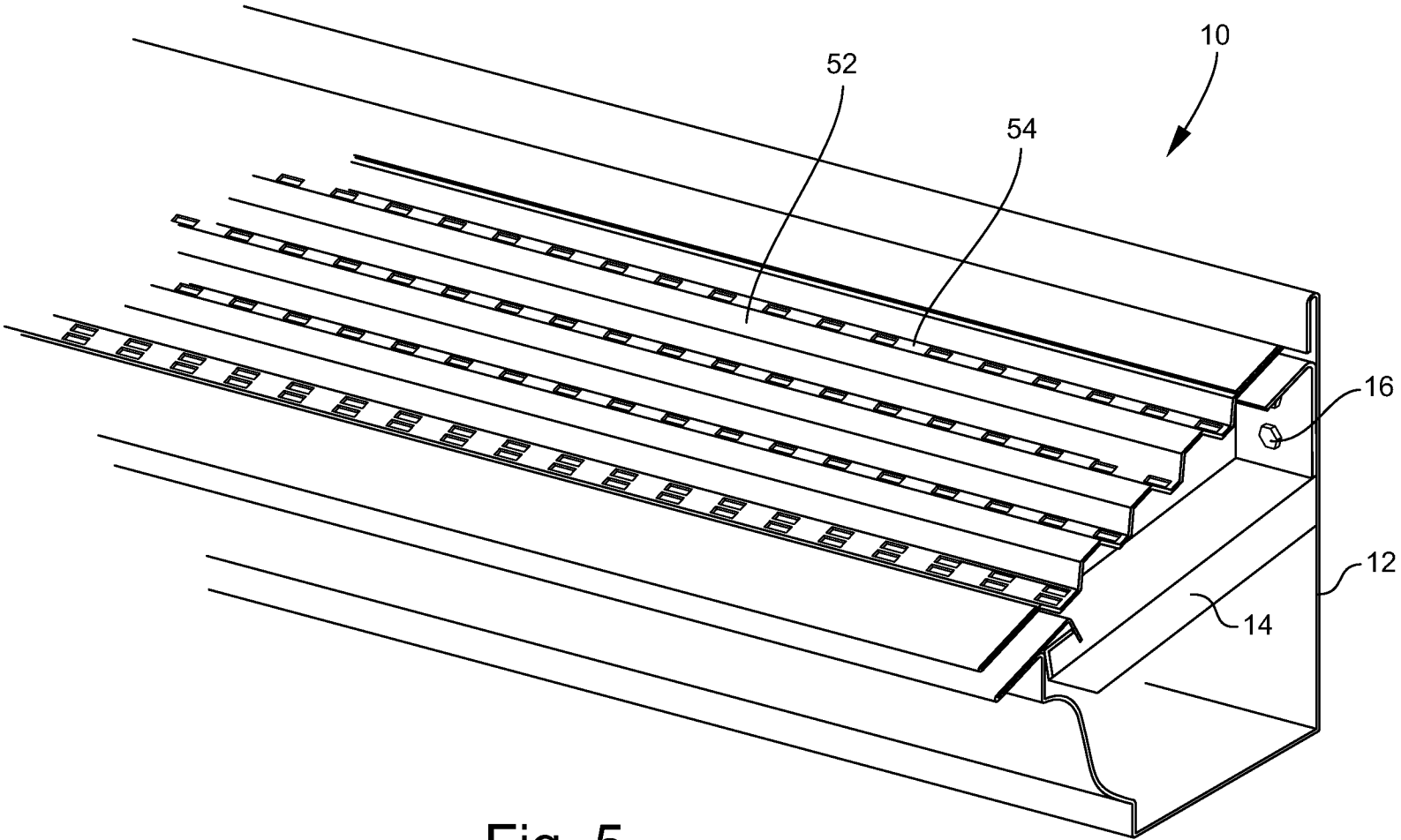
FIG. 5 is a front and right side perspective view of the rain gutter system shown with the gutter cover installed and the end cap removed.

As best shown in FIGS. 1 and 4, hangers 14 are installed in gutter 12 such that drip edge 32 and support surfaces 46 of the rear flanges 42 are coplanar and sloped in the direction toward drip edge 32. As best shown in FIGS. 1 and 5, debris cover 52 is cooperatively supported by support surface 46 of rear flange 42 and drip edge 32 in a sloped orientation in the direction of drip edge 32 such that water run-off from roof 20 is directed toward channels 54 defined by debris cover 52. In an exemplary embodiment, debris cover 52 is positioned at an angle of about 23-degrees with respect to horizontal, although alternative angles are envisioned so long as they are adequate for allowing time to collect water while allowing debris to wash over and blow off. Predetermined slopes, such as "4 in 12" or "5 in 12" slopes known to those skilled in the art are also envisioned, at an incline corresponding to about the incline of overlying roof 20.

Rain gutter system 10 is configured for use with a variety of conventional debris cover designs, preferable designs generally including water-collecting channels covered with a fine mesh or "micromesh". As shown, channels 54 define openings therethrough for passing water through to channel 28. The width of the mesh portion relative to the surface of debris cover 52 is dependent upon the amount of water desired to pass therethrough, and may be selected based on the distance required to be bridged from fascia 18 to the overlying roof edge. Thus, the mesh portion may range from about 1 to several inches in length.

Figure 6:
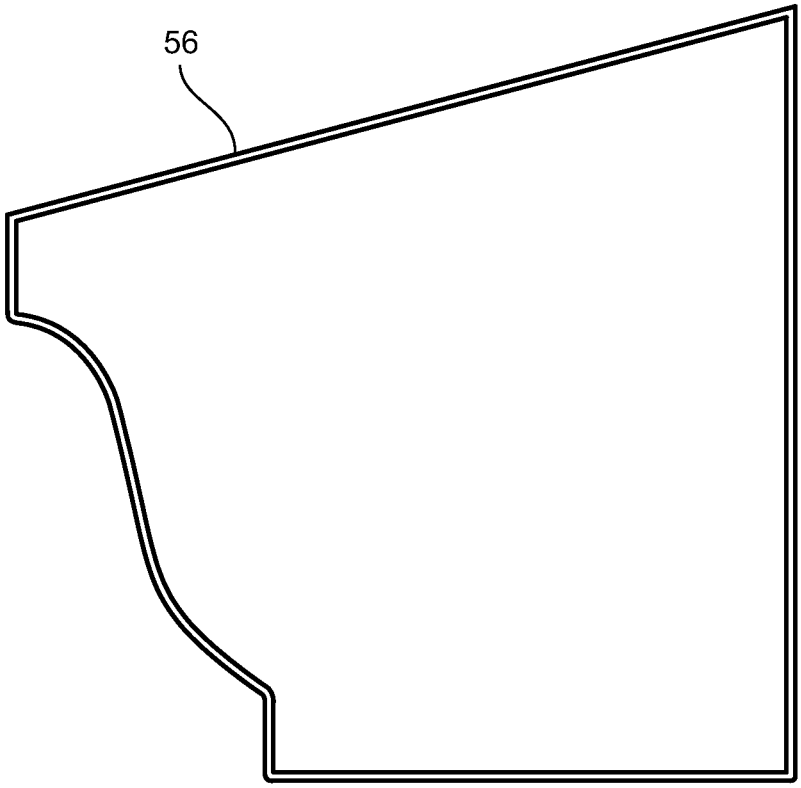
FIG. 6 is a side elevational view of the gutter end cap.

Referring specifically to FIG. 6, end cap 56 has a perimeter shaped to generally correspond to the shaped defined by the collection of the profiles of front wall 22, bottom 26, back wall 24 and cover 52. End cap 56 preferably sealingly engages gutter 12 and may be secured to gutter 12 by interference fit or using mechanical fasteners. End caps are provided in left- and right-handed versions to close off both ends of gutter 12. End cap 56 may be stamped or bent. End cap 56 may further function to maintain debris cover 52 in place, or alternatively, debris cover 52 may function to help to maintain end cap 56 in place, depending upon which overlaps.

While a gutter system has been described with reference to specific embodiments and examples, it is envisioned that various details of the invention may be changed without departing from the scope of the invention. Furthermore, the foregoing description of the preferred embodiments of the invention and best mode for practicing the invention are provided for the purpose of illustration only and not for the purpose of limitation.

What is claimed is:

1. A rain gutter system, the system comprising:
a gutter comprising:
a front wall;
a back wall,
wherein the front wall and the back wall are interconnected through a bottom and are spaced apart so as to cooperatively define a water-collecting channel therebetween, and
wherein the back wall extends upward vertically beyond an upmost point of the front wall and terminates in a fold in a direction toward the bottom;
a lip extending from the front wall in a direction toward the back wall; and
a drip edge extending from the front wall in a direction away from the back wall; and
a hanger secured within the channel between the front wall and the back wall and spaced apart from the bottom, the hanger including a forward flange extending upwardly from a base of the hanger configured to be captured beneath the lip and a rear flange extending upwardly from the base and defining a support surface sloped in a direction toward the drip edge,
wherein the drip edge and the rear flange are coplanar.

2. The rain gutter system according to claim 1, further comprising a debris cover supported on the drip edge and the rear flange and sloped in a direction toward the drip edge.

3. The rain gutter system according to claim 1, wherein the back wall is linear and perpendicular to the bottom and the front wall is non-linear.

4. The rain gutter system according to claim 1, wherein the support surface of the rear flange is spaced-apart from a free edge of the fold of the back wall.

5. The rain gutter system according to claim 1, further comprising at least one fastener advanced through the rear flange and the back wall.

6. The rain gutter system according to claim 1, wherein each of the forward flange and the rear flange are generally L-shaped.

7. The rain gutter system according to claim 1, wherein the gutter has a continuous cross-sectional profile.

8. The rain gutter system according to claim 1, further comprising an end cap.

9. The rain gutter system according to claim 1, wherein the drip edge extends from the upmost point of the front wall.

10. A rain gutter system, the system comprising:
a gutter having a continuous cross-sectional profile formed to define:
a front wall;
a back wall,
wherein the front wall and the back wall are interconnected through a bottom and are spaced apart so as to cooperatively define a water-collecting channel therebetween, and
wherein the back wall extends upward vertically beyond an upmost point of the front wall;
a lip extending from the front wall in a direction toward the back wall; and
a drip edge extending from the front wall in a direction away from the back wall; and
a hanger secured within the channel between the front wall and the back wall and spaced apart from the bottom, the hanger including a forward flange extending upwardly from a base of the hanger configured to be captured beneath the lip and a rear flange extending upwardly from the base and defining a support surface sloped in a direction toward the drip edge,
wherein the drip edge and the rear flange are coplanar.

11. The rain gutter system according to claim 10, wherein the back wall terminates at a free end in a fold in a direction toward the front wall and the bottom.

12. The rain gutter system according to claim 11, wherein the free end of the fold is spaced-apart from the support surface of the rear flange.

13. The rain gutter system according to claim 10, further comprising a debris cover supported on the drip edge and the rear flange and sloped in a direction toward the drip edge.

14. The rain gutter system according to claim 10, wherein the back wall is linear and perpendicular to the bottom and the front wall is non-linear.

15. The rain gutter system according to claim 10, further comprising at least one fastener advanced through the rear flange and the back wall.

16. The rain gutter system according to claim 10, wherein each of the forward flange and the rear flange are generally L-shaped.

17. The rain gutter system according to claim 10, further comprising an end cap.

18. The rain gutter system according to claim 10, wherein the drip edge extends from the upmost point of the front wall.

* * * * *